US011686059B2

(12) United States Patent
Szoo

(10) Patent No.: US 11,686,059 B2
(45) Date of Patent: Jun. 27, 2023

(54) DE-ICING APPARATUS

(71) Applicant: William Matthew Szoo, Delta (CA)

(72) Inventor: William Matthew Szoo, Delta (CA)

( * ) Notice: Subject to any disclaimer, the term of this patent is extended or adjusted under 35 U.S.C. 154(b) by 154 days.

(21) Appl. No.: 17/301,311

(22) Filed: Mar. 31, 2021

(65) Prior Publication Data

US 2022/0316163 A1 Oct. 6, 2022

(51) Int. Cl.
*E01H 5/02* (2006.01)
*E01H 10/00* (2006.01)

(52) U.S. Cl.
CPC ..... *E01H 10/00* (2013.01); *E01H 5/02* (2013.01)

(58) Field of Classification Search
CPC ..... E01H 5/02; E01H 10/00; E01H 10/007; E01C 2019/206
USPC ..... 294/54.5, 59; 37/230, 285
See application file for complete search history.

(56) References Cited

U.S. PATENT DOCUMENTS 2,997,796 A * 8/1961 Pogue ..... E01C 19/202 37/285
5,309,654 A 5/1994 Mathis
7,673,401 B1 3/2010 Muti et al.
8,381,420 B1 * 2/2013 Hippie ..... E01C 19/203 239/650
8,708,382 B2 * 4/2014 Hernandez ..... G01V 3/081 294/51
D791,061 S 7/2017 Kassouni
10,000,901 B1 * 6/2018 Gallo ..... E01H 5/02
2006/0230644 A1 10/2006 Stecker
2006/0251465 A1 11/2006 Savoia
2015/0204038 A1 7/2015 Faraci et al.

FOREIGN PATENT DOCUMENTS

FR 2758346 A1 * 7/1998 ..... E01H 5/02

* cited by examiner

*Primary Examiner* — Dean J Kramer
(74) *Attorney, Agent, or Firm* — Orin Del Vecchio

(57) ABSTRACT

An apparatus configured to be secured to a shovel and provide distribution of material during use of the shovel. The present invention includes a body having a hollow interior volume. The body has an upper end with and opening providing access to the interior volume. The lower end of the body includes a first portion and second portion that extend in opposing directions. A plurality of apertures are formed in the first portion and second portion of the body so as to provide spreading of a material as the shovel is utilized. The body is releasably secured to a mount wherein the mount is secured to the handle of the shovel. The mount includes a pair of support arms that are configured to cradle the lower end of the body. The body includes a slot formed therein that is operable to be releasably secured to a clip on the mount.

12 Claims, 3 Drawing Sheets

DE-ICING APPARATUS

FIELD OF THE INVENTION

The present invention relates generally to snow and ice removal, more specifically but not by way of limitation, an apparatus configured to be secured to a snow shovel wherein the present invention is operable to spread materials such as but not limited to salt during utilization of the shovel.

BACKGROUND

Millions of people live in climates that has regular snowfall in the winter season. Whether its streets, driveways or sidewalks, the snow is typically removed in order to allow a safe and normal use thereof. Snowplows are used to move large amounts of snow from roads and it is often that these snowplows will additionally deposit sand or salt as the snow is being removed so as to treat the road surface. Driveways and sidewalks must be cleared as well in order to provide safe use thereof. Driveways and sidewalks are often cleared using either a small snow blower or a snow shovel. The latter is commonly utilized for small areas and when the snow accumulation is not substantial.

It is common subsequent to removal of the snow from a driveway or sidewalk to treat the surface with a material that either helps prevent the formation of ice or adds traction to the surface. Common materials to provide the aforementioned are sand and salt. Ensuing utilization of the snow shovel, an individual will then employ a separate tool or may perform manually the spreading of salt or sand on the surface that was just shoveled.

It is intended within the scope of the present invention to provide an apparatus that is secured to a snow shovel wherein the apparatus provides distribution of a material such as but not limited to sand or salt while during utilization of the shovel.

SUMMARY OF THE INVENTION

It is the object of the present invention to provide an apparatus operable to provide distribution of sand or salt on a surface wherein the present invention includes a body that is operably coupled to the handle of a snow shovel.

Another object of the present invention is to provide a de-icing device that is configured to be secured to a snow shovel and provide distribution of a material during use of the snow shovel wherein the body of the present invention is hollow.

A further object of the present invention is to provide an apparatus operable to provide distribution of sand or salt on a surface wherein the body includes a lower end having a first portion and a second portion extending in opposing directions.

Still another object of the present invention is to provide a de-icing device that is configured to be secured to a snow shovel and provide distribution of a material during use of the snow shovel wherein the body of the present invention further includes a plurality of apertures formed in the first portion and second portion.

An additional object of the present invention is to provide an apparatus operable to provide distribution of sand or salt on a surface wherein the body includes an opening at the upper end thereof.

Yet a further object of the present invention is to provide a de-icing device that is configured to be secured to a snow shovel and provide distribution of a material during use of the snow shovel wherein the body is operably coupled to a mount that is secured to the handle of the snow shovel.

Another object of the present invention is to provide an apparatus operable to provide distribution of sand or salt on a surface wherein the mount of the present invention includes a first support arm and a second support arm.

An alternate object of the present invention is to provide a de-icing device that is configured to be secured to a snow shovel and provide distribution of a material during use of the snow shovel wherein the mount further includes a clip operable to engage the body of the present invention.

Still a further object of the present invention is to provide an apparatus operable to provide distribution of sand or salt on a surface wherein the body further includes a handle.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
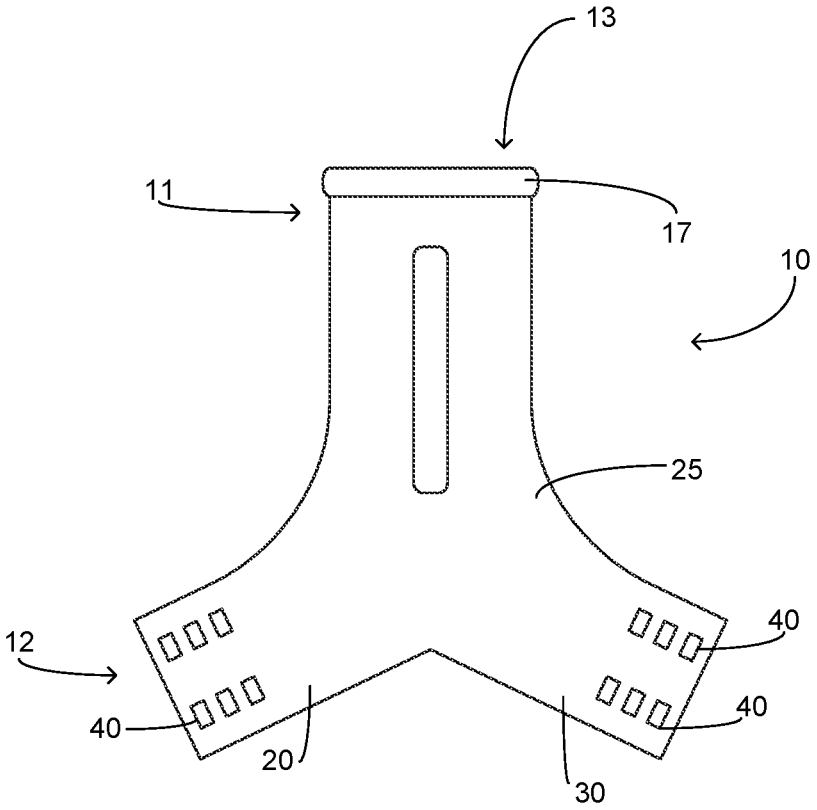
FIG. 1 is a front view of the body of the present invention.
Figure 2:
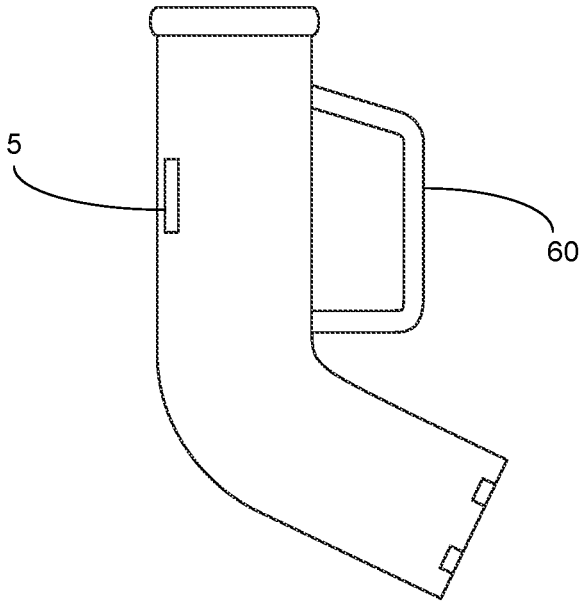
FIG. 2 is a side view of the body of the present invention.

Referring now to the drawings submitted herewith, wherein various elements depicted therein are not necessarily drawn to scale and wherein through the views and figures like elements are referenced with identical reference numerals, there is illustrated a de-icing apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms “a”, “an” and “the”

include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the drawings submitted herewith, the de-icing apparatus 100 includes a body 10. The body 10 is manufactured from a suitable rigid material such as but not limited to plastic. The body 10 includes an upper end 11 and lower end 12. The body 10 is hollow and includes an opening 13 proximate the upper end 11. Opening 13 is to facilitate the deposit of materials into the interior volume of the body 10. Opening 13 is covered with lid 17 wherein the lid 17 is biasly secured with a spring or similar element so as to maintain the lid 17 in a closed position during use of the de-icing apparatus. It should be understood within the scope of the present invention that the body 10 could have placed within the interior volume thereof materials such as but not limited to salt or sand so as to treat a desired surface while utilizing shovel 99.

The body 10 includes a first portion 20 and second portion 30 that are contiguously formed. The first portion 20 and second portion 30 extend in opposing directions away from the central portion 25. The formation of the first portion 20 and second portion 30 provides a Y-like shape to the body 10. This shape places the apertures 40 below the upper edge 98 of the shovel blade 97. Having the apertures 40 below the upper edge 98 ensures that the distribution of the material disposed within the interior volume of the body 10 will be behind the shovel 99 during use of the de-icing apparatus 100. The formation of the first portion 20 and second portion 30 further places them in a location so as to facilitate a wider distribution of material. While a particular shape of the body 10 is illustrated and discussed herein, it should be understood within the scope of the present invention that the body 10 could have a single portion proximate the lower end 12 instead of the first portion 20 and second portion 30.

The apertures 40 are formed in the first portion 20 and second portion 30 utilizing suitable techniques. It should be understood within the scope of the present invention that the apertures 40 could be formed in various shapes and sizes. Furthermore, it should be understood within the scope of the present invention that the body 10 could have formed therein various quantities of apertures 40. Handle 60 is integrally secured to the body 10 and is a conventional handle operable to provide a technique to carry and/or the body 10 when filling with material. It should be understood within the scope of the present invention that the handle 60 could be provided in various shapes and sizes.

Formed in the body 10 opposite the handle 60 is slot 5. Slot 5 is a recess in the wall of the body 10 wherein the slot 5 is configured to releasably secure to clip 52. The slot 5 and clip 52 provide a technique to releasably secure the body 10 into the mount 70. It should be understood within the scope of the present invention that the de-icing apparatus 100 could employ alternate elements in place of and/or in conjunction with the slot 5 and clip 52 in order to achieve the desired objective of releasably securing the body 10 to the mount 70.

Mount 70 is manufactured from a suitable durable material such as but not limited to plastic. Mount 70 is secured to the handle 95 utilizing support bands 72 that are circumferentially secured to the handle 95. It should be understood within the scope of the present invention that the mount 70 could deploy alternate quantities of support bands 72 to secure the mount 70 to the handle 95. Furthermore, it should be understood within the scope of the present invention that the mount 70 could be secured to the handle 95 utilizing alternate types of fasteners.

Figure 3:
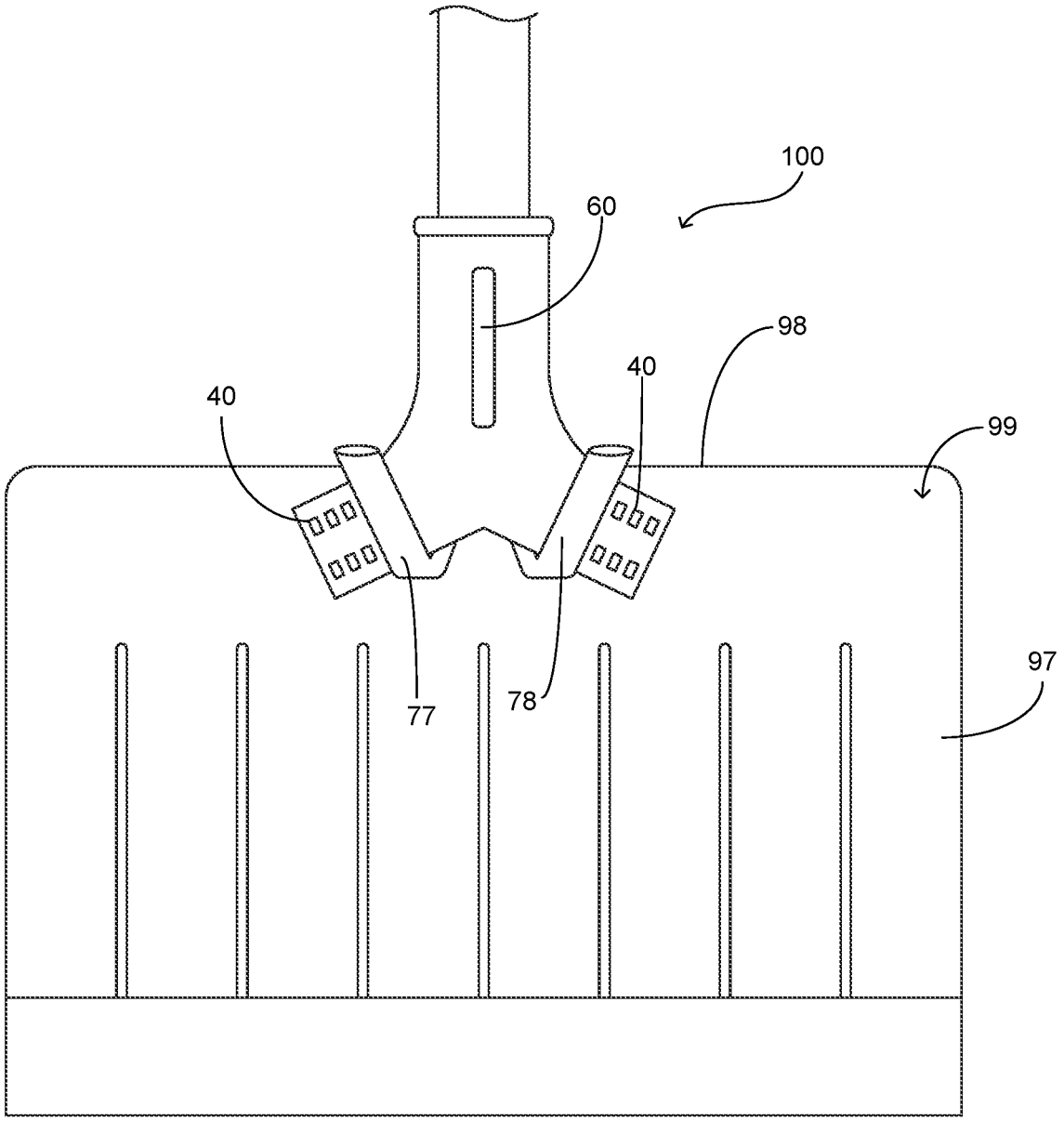
FIG. 3 is a rear view of the invention secured to a snow shovel.
Figure 4:
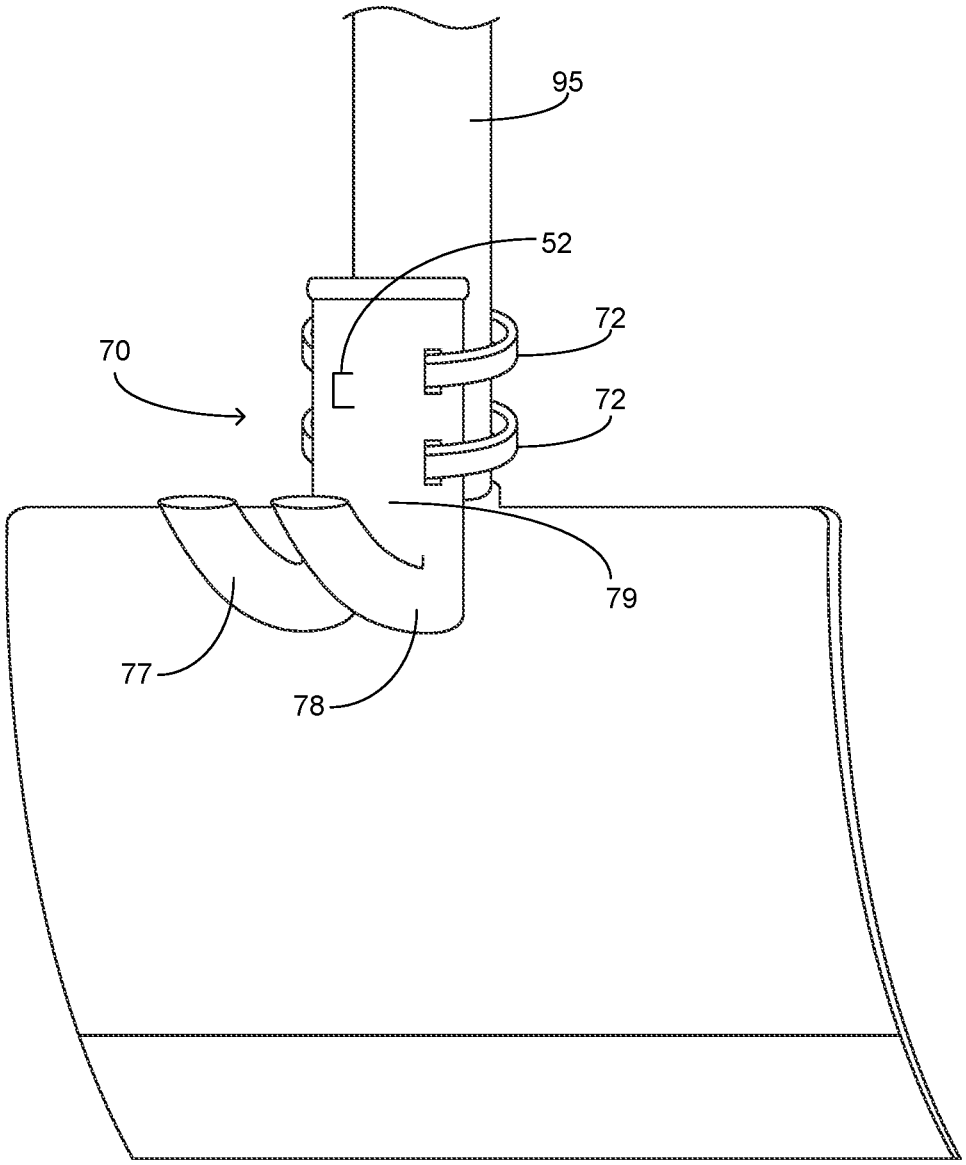
FIG. 4 is a perspective view of the mount of the present invention.

Mount 70 includes a first support arm 77 and a second support arm 78. The first support arm 77 and second support arm 78 extend outward from the center section 79 of the mount 70 and are contiguously formed therewith. The first support arm 77 and second support arm 78 are slightly arcuate in formation so as to cradle the body 10. The first support arm 77 and second support arm 78 are further positioned so as to slightly angle away from each other as is shown in FIG. 3 submitted herewith. This provides an improved engagement of the first portion 20 and second portion 30 of the body 10. It should be understood within the scope of the present invention that the mount 70 could employ a single support arm or more than two support arms as needed to operably couple a body 10 of an alternate shape. Furthermore, it should be understood within the scope of the present invention that alternate elements could be deployed to provide support for the body 10 in place of and/or in conjunction with the first support arm 77 and second support arm 78. While a particular mount 70 has been illustrated herein, it is contemplated within the scope of the present invention that the body 10 could be releasably secured to the handle 95 utilizing numerous alternate types of fasteners and/or mounts.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. An apparatus configured to be secured to a handle of a shovel and provide distribution of material during use of the shovel wherein the apparatus comprises:

a body, said body having an upper end and a lower end, said body having a hollow interior volume, said body having an opening proximate said upper end, said body further having a plurality of apertures proximate said lower end; and a mount, said mount being secured to the handle of the shovel, said mount configured to have said body releasably secured thereto and said mount includes at least one support arm, said at least one support arm operable to have a portion of the body superposed thereon wherein said body is configured to be secured to the handle of a shovel and distribute a material disposed within the interior volume via the plurality of apertures.

2. The apparatus configured to be secured to a handle of a shovel and provide distribution of material as recited in claim 1, wherein said mount further includes a clip, said clip extending outward from said mount.

3. The apparatus configured to be secured to a handle of a shovel and provide distribution of material as recited in claim 2, wherein said body further includes a slot, said slot operable to engage said clip so as to releasably secure said body to said mount.

4. The apparatus configured to be secured to a handle of a shovel and provide distribution of material as recited in claim 3, wherein said body further includes a handle.

5. A de-icing apparatus that is configured to be secured to a handle of a snow shovel so as to spread salt during utilization of the snow shovel wherein the de-icing apparatus comprises:

a body, said body having an upper end and a lower end, said body having a hollow interior volume, said body having an opening proximate said upper end, said body having a first portion and a second portion wherein the first portion and the second portion are located at said lower end of said body, said first portion and said second portion being contiguously formed with a center portion of said body, said first portion and said second portion of said body extending in opposing directions, said first portion and said second portion of said body having a plurality of apertures formed therein;

a mount, said mount being secured to the handle of the snow shovel, said mount having a central portion, said mount having an upper end and a lower end, said mount having a first support arm and a second support arm, said first support arm and said second support arm being proximate said lower end of said mount, said first support arm and said second support arm extending outward from said mount; and wherein said body is releasably secured to said mount.

6. The de-icing apparatus that is configured to be secured to a handle of a snow shovel so as to spread salt during utilization of the snow shovel as recited in claim 5, wherein said first portion of said body is positioned to be lower than an upper edge of a blade of the snow shovel.

7. The de-icing apparatus that is configured to be secured to a handle of a snow shovel so as to spread salt during utilization of the snow shovel as recited in claim 6, wherein said body is Y-shaped.

8. The de-icing apparatus that is configured to be secured to a handle of a snow shovel so as to spread salt during utilization of the snow shovel as recited in claim 7, wherein said second portion of said body is positioned to be lower than the upper edge of the blade of the snow shovel.

9. The de-icing apparatus that is configured to be secured to a handle of a snow shovel so as to spread salt during utilization of the snow shovel as recited in claim 8, wherein said first support arm and said second support arm are configured to extend away from each other.

10. The de-icing apparatus that is configured to be secured to a handle of a snow shovel so as to spread salt during utilization of the snow shovel as recited in claim 9, wherein said mount further includes at least one support band, said at least one support band configured to secure said mount to the handle of the snow shovel.

11. The de-icing apparatus that is configured to be secured to a handle of a snow shovel so as to spread salt during utilization of the snow shovel as recited in claim 10, wherein said mount further includes a clip, said clip extending outward from said mount.

12. The de-icing apparatus that is configured to be secured to a handle of a snow shovel so as to spread salt during utilization of the snow shovel as recited in claim 11, wherein said body further includes a slot, said slot operable to engage said clip so as to releasably secure said body to said mount.

* * * * *